US012534172B1

(12) United States Patent
Neibert et al.

(10) Patent No.: US 12,534,172 B1
(45) **Date of Patent: *Jan. 27, 2026**

(54) FOLDABLE BOAT LADDER ALARM

(71) Applicant: T-H Marine Supplies, LLC, Huntsville, AL (US)

(72) Inventors: Mark Neibert, Millersburg, IN (US); Eric Griggs, Madison, AL (US)

(73) Assignee: T-H Marine Supplies, LLC, Huntsville, AL (US)

( * ) Notice: Subject to any disclaimer, the term of this patent is extended or adjusted under 35 U.S.C. 154(b) by 769 days.

This patent is subject to a terminal disclaimer.

(21) Appl. No.: 17/941,447

(22) Filed: Sep. 9, 2022

Related U.S. Application Data

(63) Continuation-in-part of application No. 16/849,159, filed on Apr. 15, 2020, now Pat. No. 11,440,627.

(60) Provisional application No. 62/853,968, filed on May 29, 2019.

(51) Int. Cl.

| | |
|---|---|
| ***B63B 27/14*** | (2006.01) |
| ***B63B 79/10*** | (2020.01) |
| ***B63H 21/21*** | (2006.01) |

(52) U.S. Cl.
CPC ..... *B63H 21/21* (2013.01); *B63B 27/146* (2013.01); *B63B 79/10* (2020.01)

(58) Field of Classification Search
CPC ... E06C 7/003; E06C 5/34; E06C 5/44; B63B 27/146; B63B 45/04
See application file for complete search history.

(56) References Cited

U.S. PATENT DOCUMENTS

| | | | | |
|---|---|---|---|---|
| 10,189,548 | B1 | 1/2019 | Moore | |
| 10,424,911 | B2 | 9/2019 | McTighe, Jr. et al. | |
| 10,793,245 | B1 | 10/2020 | Trotter | |
| 2008/0308031 | A1* | 12/2008 | Sedlack, II | E06C 1/381 114/362 |
| 2017/0144604 | A1* | 5/2017 | Doy | B60R 3/02 |

* cited by examiner

*Primary Examiner* — Benyam Haile
(74) *Attorney, Agent, or Firm* — Bradley Arant Boult Cummings LLP; Stephen H. Hall; Alex H. Huffstutter

(57) ABSTRACT

A boat ladder alarm system for a foldable boat ladder having a base rail and a movable rail is disclosed. In one embodiment, the boat ladder alarm system includes a first bracket, a second bracket, and a sensor system. The sensor system is configured to trigger an alarm when the first bracket and the second bracket are unconnected and to turn off the alarm when the first bracket and the second bracket are connected. In this manner, if the foldable boat ladder is unfolded and someone is trying to climb on the boat, the alarm is triggered to warn the boat operator that it is not safe to turn on the boat engine.

20 Claims, 16 Drawing Sheets

FOLDABLE BOAT LADDER ALARM

RELATED APPLICATIONS

This application is a continuation-in-part application of U.S. application Ser. No. 16/849,159, filed Apr. 15, 2020, which claims the benefit of provisional patent application Ser. No. 62/853,968, filed May 29, 2019, the disclosures of which are hereby incorporated herein by reference in their entirety.

FIELD OF THE DISCLOSURE

This disclosure relates generally to alarm systems for recreational boats.

BACKGROUND

Boat ladders are often attached to the back of recreational boats in order to assist boat riders in getting back in the boat after swimming. Many of these ladders have at least two primary orientations, one in a "deployed" position when being used by persons trying to get into the boat, and a "stowed" position when not in use and/or when the boat is in motion. These types of ladders may generally be referred to as "collapsible" ladders and are often in a foldable configuration (discussed further below), but also may be in an extendable configuration where a portion of the ladder slides largely in a vertical motion up or down (up in the "stowed" position, and down in the "deployed" position). Some ladders include portions that both fold, and have rails that are collapsible, for example, using telescoping rails. A variety of different collapsible configurations are known to those of skill in the art. For the sake of simplicity, the remaining disclosure is focused on the use of a foldable boat ladder, but those of skill in the art will recognize that the invention may also be used with other collapsible ladder configurations. Thus, while the boat is in operation, the foldable boat ladder is folded to prevent the foldable boat ladder from creating drag and so that the boat ladder does not get damaged. After boat riders go swimming or skiing and need to get back onto the boat, the foldable boat ladder is unfolded thereby placing a portion of the ladder in the water in order to assist the boat rider in climbing back onto the boat.

Unfortunately, these ladders are often placed near the boat engine. As a result, accidents where people are seriously injured by the boat propeller can occur. If the boat operator is unaware that a boat rider is trying to climb back into the boat, the boat operator may turn on the boat engine while someone's arms or legs are dangling near the boat propeller. Thus, boat accidents can occur if the boat operator is unaware that someone is attempting to climb into the boat using the foldable boat ladder.

Thus, what is needed are systems and methods of preventing boating accidents when boat riders are trying to climb back into the boat using a foldable boat ladder.

SUMMARY

A boat ladder alarm system for a foldable boat ladder having a base rail and a movable rail is disclosed. In one embodiment, the boat ladder alarm system includes a first bracket, a second bracket, and a sensor system. The first bracket is configured to connect to both the base rail and the movable rail of the foldable boat ladder when the foldable boat ladder is folded and to connect to the base rail and disconnect from the movable rail when the foldable boat ladder is unfolded. The second bracket is configured to connect to the movable rail and the first bracket when the foldable boat ladder is folded and to connect to the movable rail and disconnect from the first bracket when the foldable boat ladder is unfolded. The sensor system is configured to trigger an alarm when the first bracket and the second bracket are unconnected and to turn off the alarm when the first bracket and the second bracket are connected. In this manner, if the foldable boat ladder is unfolded, the alarm is triggered to warn the boat operator that it is not safe to turn on the boat engine.

In some embodiments, an alarm system for a foldable boat ladder having a fixed rail and a movable rail is provided, the alarm system including a sensor configured for attachment to the fixed rail, a magnet configured for attachment to the movable rail and engagement with the sensor when the foldable boat ladder is stowed, and wherein the sensor is configured to trigger an alarm when the magnet is disengaged from the sensor. In one embodiment, the sensor is secured to a bracket configured for receiving the fixed rail. In other embodiments, the bracket includes a first grip and a second grip that form a closed loop around the fixed rail. In still other embodiments, the bracket includes a section that extends vertically downward from the second grip and defines a sensor aperture for receiving the sensor. In yet other embodiments, the magnet is provided in a housing configured for attachment to the movable rail. In still further embodiments, the housing includes a shim attached thereto. In other embodiments, the magnet is provided in the housing so as to face the sensor when the foldable boat ladder is stowed so that the alarm is turned off.

In other embodiments, an alarm system for a foldable boat ladder having a fixed rail and a movable rail is provided, the alarm system including a sensor attached to the fixed rail, a magnet attached to the movable rail and operatively engaged with the sensor when the foldable boat ladder is stowed, and wherein the sensor is configured to prevent the boat from starting when the magnet is disengaged from the sensor. In some embodiments, the sensor is secured to a bracket, the bracket including a first grip and a second grip that form a closed loop around the fixed rail. In other embodiments, the bracket includes a section that extends vertically downward from the second grip and defines a sensor aperture for receiving the sensor. In further embodiments, the magnet is provided in a housing configured for attachment to the movable rail. In still further embodiments, the housing includes a plurality of apertures for receiving a fastener. In yet further embodiments, the housing includes a shim attached thereto for additional spacing. In still further embodiments, the sensor is configured to allow the boat to start when the magnet is operatively engaged with the sensor.

In yet other embodiments, an alarm system for a boat ladder is provided, the alarm system including a sensor configured to be attached to a first rail, a magnet configured to be attached to a second rail, wherein the magnet is positioned proximate to and operatively engaged with the sensor, and wherein the sensor is configured to perform at least one of the following when the magnet is disengaged from the sensor: trigger an alarm or prevent the boat from starting. In some embodiments, the first rail is a fixed rail of the boat ladder and the second rail is a movable rail of the boat ladder. In other embodiments, the boat ladder is a telescoping ladder. In still further embodiments, the sensor is configured to prevent the boat from starting when the magnet is disengaged from the sensor and to allow the boat to start when the magnet is engaged with the sensor. In yet further embodiments, the sensor is configured to trigger an alarm when the magnet is disengaged from the sensor and to turn off the alarm when the magnet is engaged with the sensor. In further embodiments, the sensor is secured to a bracket, the bracket including a first grip and a second grip that clamp around the first rail.

Those skilled in the art will appreciate the scope of the present disclosure and realize additional aspects thereof after reading the following detailed description of the preferred embodiments in association with the accompanying drawing figures.

BRIEF DESCRIPTION OF THE DRAWINGS

The accompanying drawings incorporated in and forming a part of this specification illustrate several aspects of the disclosure, and together with the description serve to explain the principles of the disclosure.

DETAILED DESCRIPTION

The embodiments set forth below represent the necessary information to enable those skilled in the art to practice the disclosure and illustrate the best mode of practicing the disclosure. Upon reading the following description in light of the accompanying drawings, those skilled in the art will understand the concepts of the disclosure and will recognize applications of these concepts not particularly addressed herein. It should be understood that these concepts and applications fall within the scope of the disclosure and the accompanying claims.

Figure 1B:
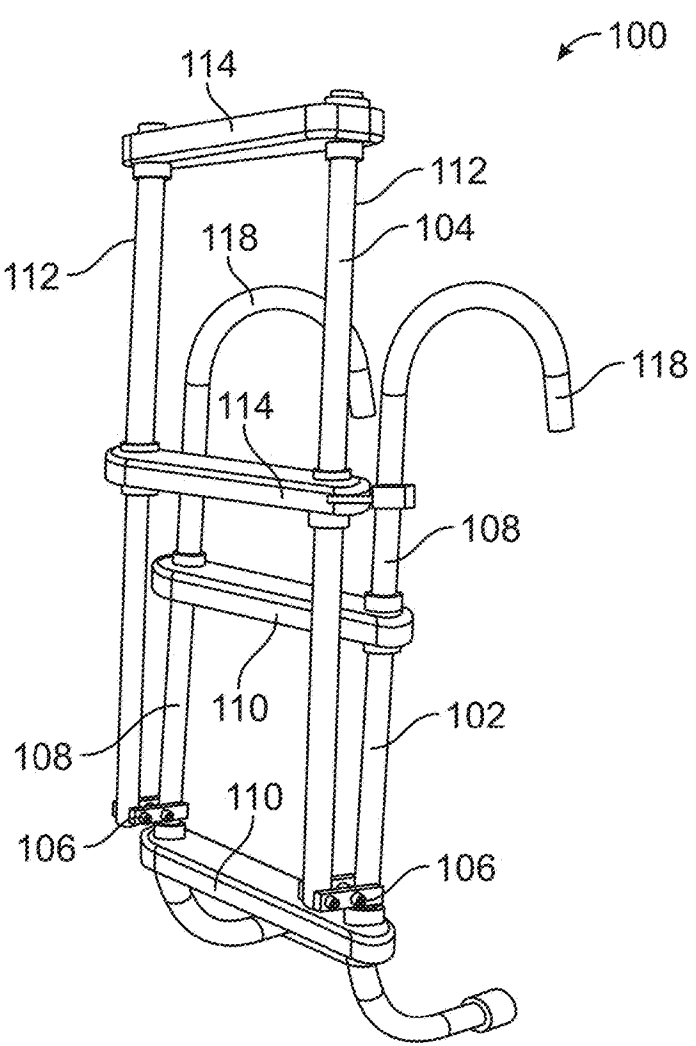
FIG. 1A and FIG. 1B illustrate a foldable boat ladder, with FIG. 1A showing a deployed position and FIG. 1B showing a stowed position.
Figure 1A:
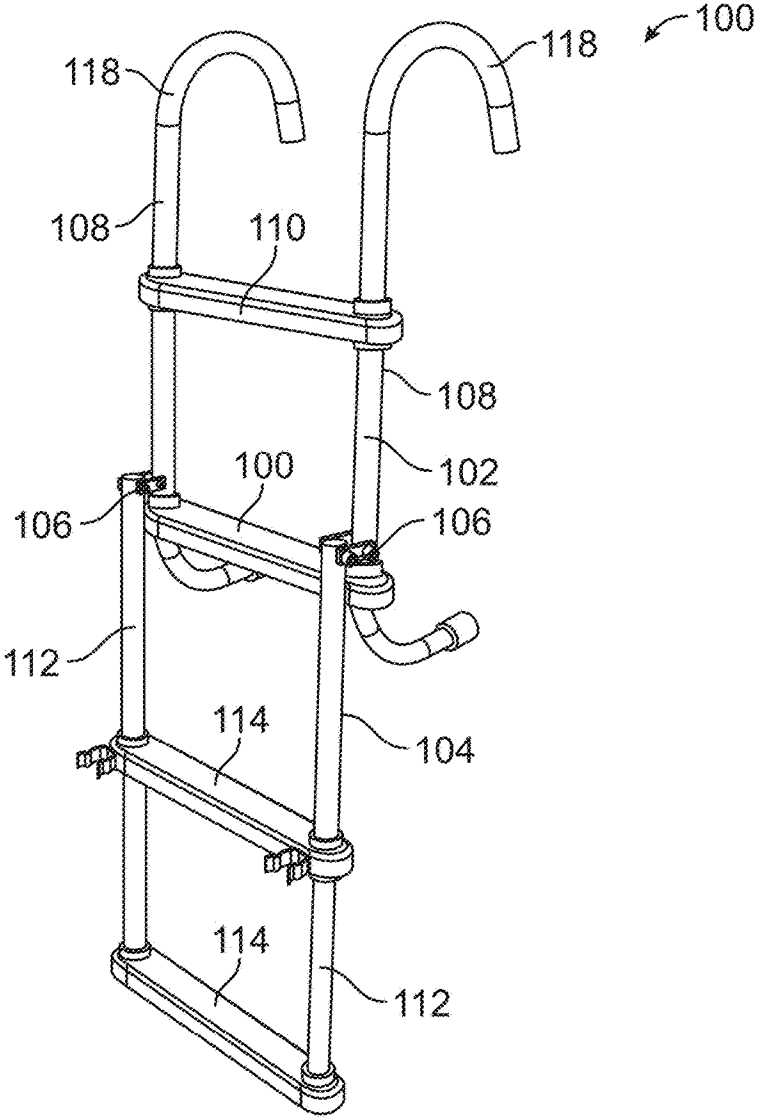

FIG. 1A and FIG. 1B illustrate one embodiment of a foldable boat ladder 100. FIG. 1A illustrates the foldable boat ladder 100 unfolded so that it can be used to climb onto a boat (not explicitly shown). FIG. 1B illustrates the foldable boat ladder 100 in the folded position, which is the position that it is generally placed when the boat is moving, and the ladder is not being climbed. The foldable boat ladder 100 includes a base ladder section 102 and a movable ladder section 104. As shown by FIG. 1A and FIG. 1B, the movable ladder section 104 is movably connected to the base ladder section 102 by a pair of hinges 106. The hinges 106 permit the foldable boat ladder 100 to be moved from the folded position to the unfolded position and vice versa.

In this embodiment, the base ladder section 102 has a pair of base rails 108. Ladder steps 110 are attached between the base rails 108 so that the base ladder section 102 forms the top of the foldable boat ladder 100 when the foldable boat ladder 100 is unfolded. Additionally, the movable ladder section 104 has a pair of movable rails 112. Ladder steps 114 are attached between the movable rails 112 so that the movable ladder section 104 forms the bottom of the foldable boat ladder 100 when the foldable boat ladder 100 is unfolded. The top end portions 118 of the base rails 108 form hooks to allow the foldable boat ladder 100 to attach to the boat, generally to the back of the boat. Those of skill in the art will recognize that may ladders will not have top end portions 118 in the form of hooks but will be separately attached to the hull of the boat, for example by brackets or other attachment mechanisms. Additionally, while the ladder shown in FIGS. 1A and 1B have 2 separate base rails 108 and movable rails 112, other embodiments (not shown) may have one central base rail 108 and one movable rail 112 with the ladder steps 114 normally attached to the center of the base rail 108 and movable rail 112. Note that in the embodiment shown in FIGS. 1A and 1B, on both the left and right side of the foldable boat ladder 100, one of the base rails 108 is horizontally next to the one of the movable rails 112 when the foldable boat ladder 100 is folded. However, on both the left side and the right side of the foldable boat ladder 100, the base rails 108 and the movable rails 100 are horizontally separated when the foldable boat ladder 100 is unfolded.

Figure 2:
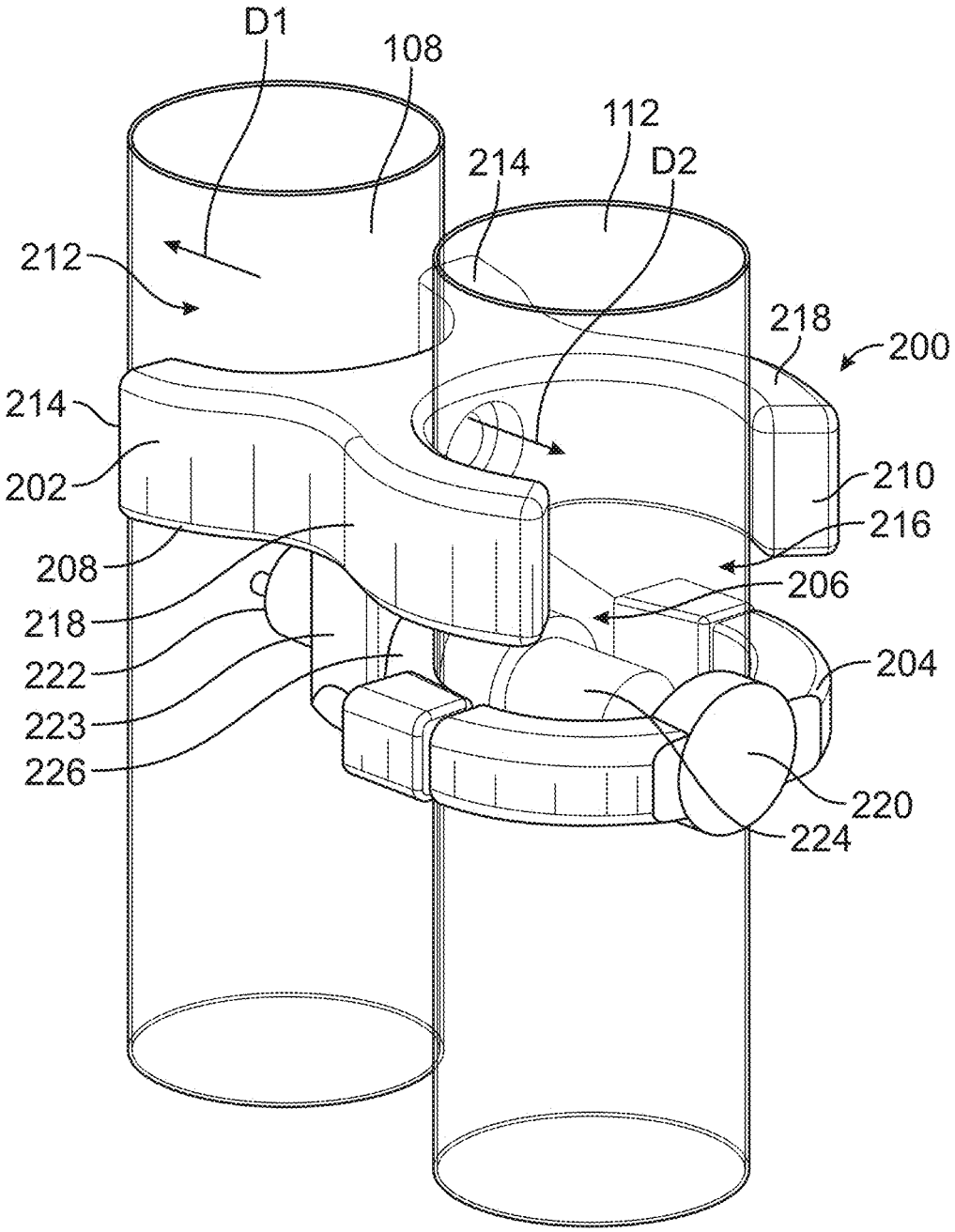
FIG. 2 illustrates one embodiment of a boat ladder alarm system.

FIG. 2 illustrates a see-through perspective view of a boat ladder alarm system 200 attached to a base rail 108 and a movable rail 112 when the foldable boat ladder 100 is in the folded (or stowed) position. As can be seen from FIG. 2, the boat ladder alarm system 200 has a first bracket 202, a second bracket 204, and a sensor system 206. The first bracket 202 is configured to connect to both the base rail 108 and the movable rail 112 of the foldable boat ladder 100 when the foldable boat ladder 100 is in the folded, as shown in FIG. 1B. When the foldable boat ladder 100 is unfolded, the first bracket 202 is configured to remain connected to the base rail 108 since the base rail 108 does not move. However, the first bracket 202 is configured to disconnect from the moveable rail 112 when the foldable boat ladder 100 is unfolded. This is because the moveable rail 112 moves and the first bracket 202 is configured so that the moveable rail 112 slips out of the first bracket 202 as the foldable boat ladder 100 is unfolded.

As shown in FIG. 2, the first bracket 202 includes a first grip 208 and a second grip 210. The first grip 208 and the second grip 210 are attached and oppositely disposed from one another. In this case, the first grip 208 is formed as an open loop so that the first grip 208 defines an opening 212 configured to receive the base rail 108. In other embodiments, the first grip 208 may be a closed grip that closes around the base rail 108. The first grip 208 shown in FIG. 2 is formed by opposing arms 214 that extend out horizontally in the direction D1.

With regard to the second grip 210, the second grip 210 is also formed as an open loop that defines an opening 216 for receiving the movable rail 112. The movable rail 112 also can be removed from the second grip 210 through the opening 216 when the foldable boat ladder 100 is unfolded. The second grip 212 is formed by opposing arms 218 that extend horizontally in a direction D2 that is opposite to the direction D1. It should be noted that while the first grip 208 and the second grip 210 are formed to receive circular rails, other embodiments of the first grip 208 and the second grip 210 may be provided to fit boat rails of any shape and dimension.

The second bracket 204 is configured to connect to the movable rail 112 and the first bracket 202 when the foldable boat ladder system 200 is folded and to connect to the movable rail 112 and disconnect from the first bracket 202 when the foldable boat ladder system 200 is unfolded. The sensor system 206 is configured to trigger an alarm (not explicitly shown) when the first bracket 202 and the second bracket 204 are unconnected and to turn off the alarm when the first bracket 202 and the second bracket 204 are connected. Thus, the sensor system 206 triggers an alarm when the foldable boat ladder system 200 is unfolded since the first bracket 202 and the second bracket 204 are unconnected. This will warn the operator of the boat that the foldable boat ladder system 200 is unfolded and that someone may be climbing onto the boat. In some embodiments, the sensor system 206 may be connected to the starter system (not explicitly shown) of the boat to prevent the boat from starting if the alarm is triggered and/or if the ladder is in the deployed position. For example, similar to a "kill switch" for a boat, the boat may be wired such that if the first and second brackets 202, 204 are not connected (and thus the ladder up in the stowed configuration), the boat will simply not start.

In this embodiment, the second bracket 204 is formed as a third grip 220. The third grip 220 forms a closed loop around the movable rail 112. In this manner, the movable rail 112 is not removed from the third grip 220 of the second bracket 204 when the foldable boat ladder system 200 is unfolded. The second grip 220 is vertically aligned but vertically displaced below the second grip 210 of the first bracket 202 when the foldable boat ladder system 200 is folded. In this manner, both the second grip 210 and the third grip 220 can engage the movable rail 112 when the foldable boat ladder system 200 is folded. However, since the second grip 210 is open and the third grip 220 is closed, the movable rail 112 is removed from the second grip 210 but is maintained connected to the third grip 220 when the foldable boat ladder system 200 is unfolded.

In this embodiment, the first bracket 202 includes section 223, which extends vertically down so as to be vertically aligned with the second bracket 204 when the foldable boat ladder system 200 is folded. Furthermore, the first bracket 202 and the second bracket 204 can be made from a plastic, metal (for example stainless steel or other metal), or other suitable materials. The sensor system 206 includes an electromagnetic sensor 222 and a magnet 224. The magnet 224 is attached to a back section 226 of the second bracket 204 and is inserted through to an interior of the movable rail 112. The magnet 224 attached to this back section 226 of the second bracket 204. The magnet 224 causes the back section 226 to become removably attached to the section 223 of the first bracket 202 when the foldable boat ladder system 200 is folded. The sensor 222 is attached to the section 223 of the first bracket 202 and through the base rail 108. The sensor 222 is configured to sense the magnetic field created by the magnet 224. When the section 223 and the back section 226 are attached, the sensor 222 senses the magnetic field and maintains the alarm off and/or allows the boat to be turned on. In another embodiment, the sensor 222 includes a switch that is connected to the alarm. When the back section 226 and the section 223 are attached, the magnet 224 maintains the switch open so that the alarm does not sound and/or so that the boat can be turned on.

Referring again to the original embodiment, when the section 223 and the back section 226 become unattached as a result of the unfolding of the foldable boat ladder system 200, the sensor 222 is configured to sense the absence of the magnetic field created by the magnet 224 and thereby turn on the alarm and/or prevent the boat from being turn on. Other types of sensors could also be used, for example, proximity sensors, mercury switches, and other types of presence sensing devices and sensors. In the alternative embodiment, when the section 223 and the back section 226 become unattached as a result of the unfolding of the foldable boat ladder system 200, the switch is closed to either turn the alarm on and/or prevent the boat from being turned on.

Figure 3:
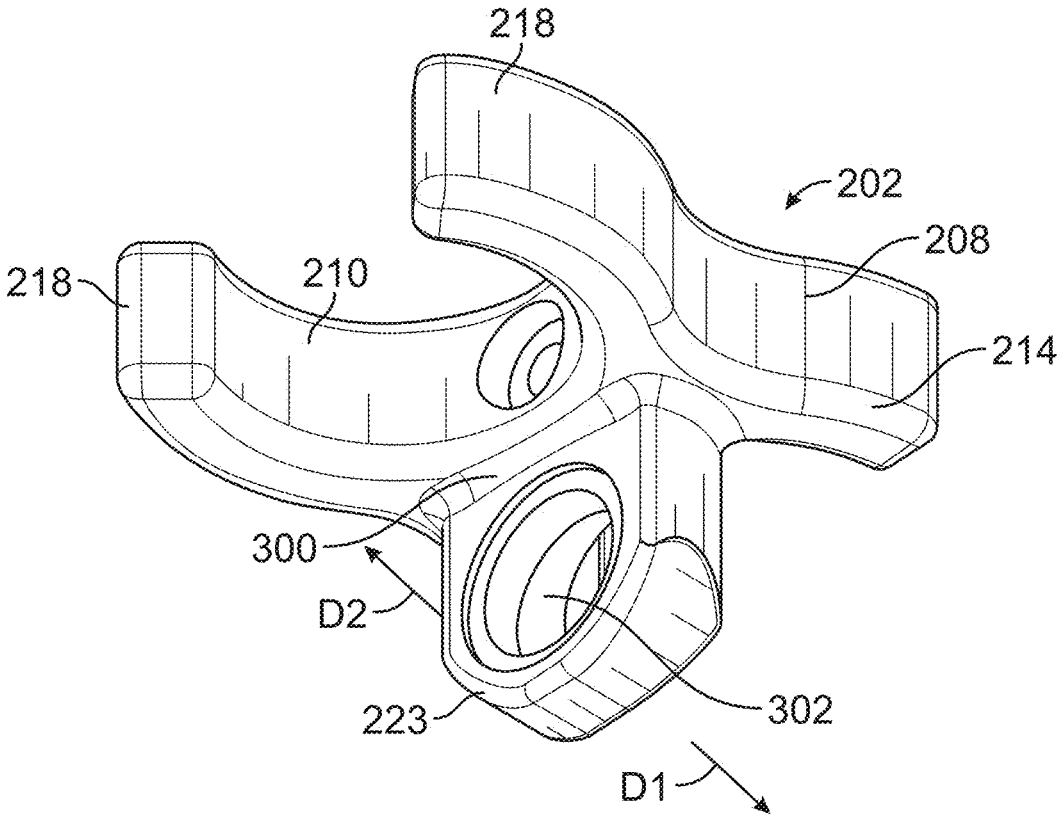
FIG. 3 illustrates one embodiment of a first bracket provided by the boat ladder alarm system shown in FIG. 2.

FIG. 3 illustrates one embodiment of the first bracket 202. As discussed above, the first bracket 202 includes the oppositely disposed first grip 208 and second grip 210. The first grip 208 and the second grip 210 are attached and oppositely disposed to one another. The opposing arms 214 (only one in shown in FIG. 3) of the first grip 208 are provided in a circular shape since the base rail 108 (shown in FIG. 1 and FIG. 2) is circular. However, in other embodiments, the opposing arms 214 may take other shapes in accordance with the shape of the base rail they are designed to fit around. With regard to the second grip 210, the second grip 210 is formed by the opposing arms 218, which in this embodiment are also formed to have a circular shape since the movable rail 112 (shown in FIG. 1 and FIG. 2) is circular. However, in other embodiments, the opposing arms 218 may take other shapes depending on the shape of the movable rail they are designed to fit around.

As shown in FIG. 3, the first grip 208 and the second grip 210 connect at intersection 300, which is formed by the closed portions of the open loops that form the first grip 208 and the second grip 210. The section 223 extends vertically downward from the intersection 300 to provide a location for attaching the sensor 222. In this embodiment, the section 223 defines a sensor aperture 302. The sensor aperture 302 is configured to fit the sensor 222 (shown in FIG. 2) so that the sensor 222 can engage the magnet 224 (shown in FIG. 2), as explained in further detail below. The section 223 is shaped so that the appropriate portions of the sensor 222 face the D2 direction and, in this manner, can sense the movement of the movable rail 112. The sensor 222 (shown in FIG. 2) would extend in the D1 direction and would be inserted into the base rail 108.

Figure 4:
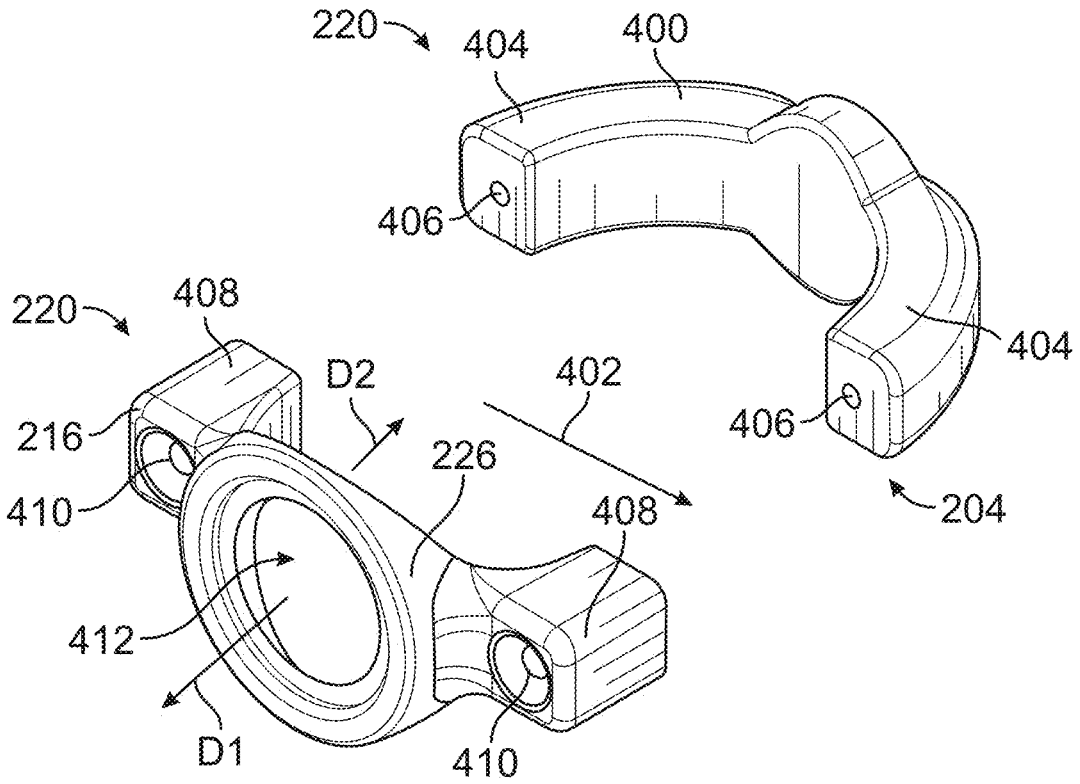
FIG. 4 illustrates one embodiment of a second bracket provided by the boat ladder alarm system shown in FIG. 2.

FIG. 4 illustrates one embodiment of the second bracket 204. As explained above, the second bracket 204 is formed as a third grip 220, which in FIG. 4 is shown disassembled. When assembled, the third grip 220 forms a closed loop that is connected around the movable rail 112. When disassembled, the third grip 220 is formed by the open loop 400 and the back section 226, which in this case is largely planar. The open loop 400 defines an opening 402 that fits around the movable rail 112. Ends 404 of the open loop 400 have screw apertures 406. Similarly, ends 408 of the back section 226 may also define screw apertures 410. Ends 404, 408 and apertures 406, 410 may be aligned and screws may be inserted through the screw apertures 406, 410 to attach the open loop 410 to the back section 226 and thereby form the closed loop around the movable rail 112. In this example, the open loop 400 has a circular shape since the movable rail 112 is circular. However, other embodiments of the open loop 400 may take other shapes in accordance with the shape of the movable rail 112 it is designed to fit around.

As shown in FIG. 4, the back section 226 has a magnet aperture 412. In this manner, the front face of the magnet 224 (shown in FIG. 2) can fit into the magnet aperture 412 and face the D1 direction towards the sensor 222 (shown in FIG. 2). In this manner, the sensor 222 can easily detect the magnetic field created by the magnet 224. In an alternative embodiment, this arrangement allows for a switch in the sensor 222 to be maintained open by the magnet 224. The magnet 224 however would extend in the D2 direction and within the movable rail 112.

Figure 5:
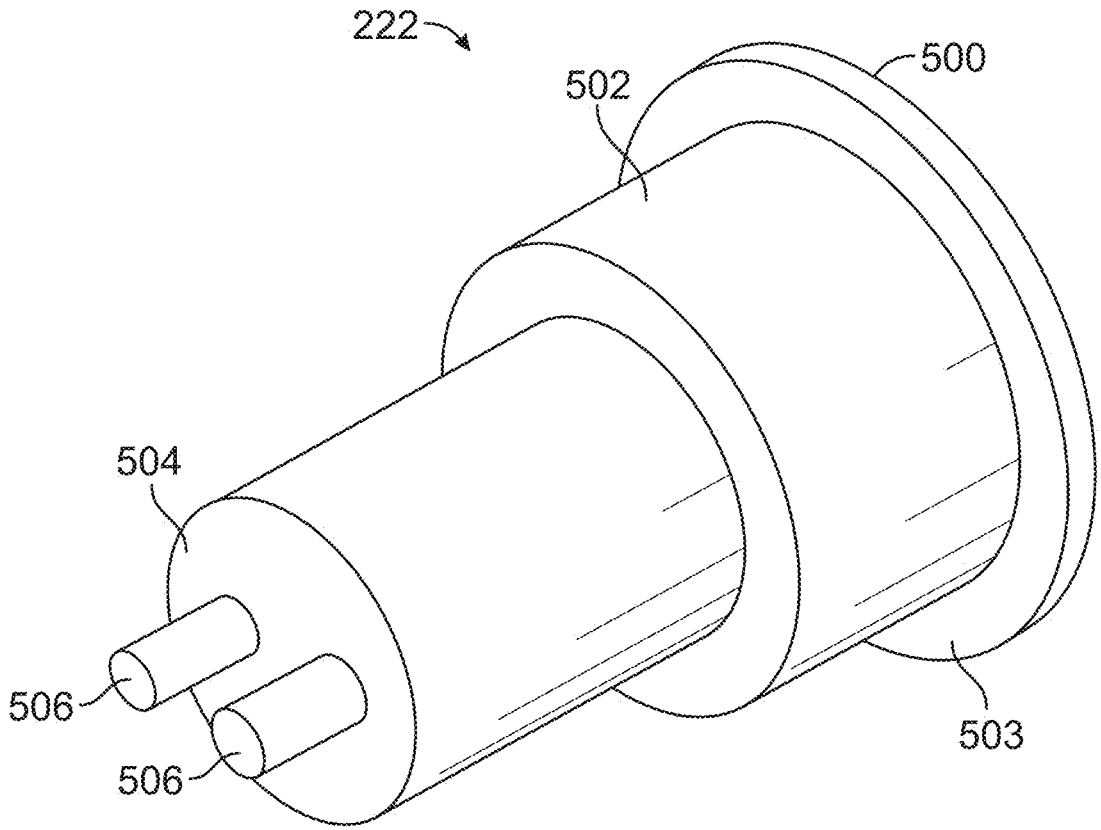
FIG. 5 illustrates one embodiment of a sensor provided by the boat ladder alarm system shown in FIG. 2.

FIG. 5 illustrates one embodiment of the sensor 222. The sensor 222 includes a front face 500 that fits within the sensor aperture 302 of the section 223. A cylindrical section 502 is attached to a back face 503 oppositely disposed from the front face 500. Another cylindrical section 504 attaches to the back of the cylindrical section 502. Cylindrical sections 502, 504 are provided in the base rail 108 (shown in FIG. 1 and FIG. 2). Positive and negative wires 506 extend through the back of the cylindrical section 504 to transmit a signal. In this embodiment, the wires 506 are potted and waterproof.

While the front face 500 is attached to the magnet 224 (shown in FIG. 2), a circuit within the sensor 222 is normally closed so that current flows through the wires 506. However, when the front face 500 is no longer attached (i.e., the movable rail 112 in FIG. 1 and FIG. 2 is provided in the unfolded position), the circuit within the sensor 222 opens and current no longer flows through the wires 506. As such, an alarm is triggered and/or the boat is prevented from being turned on.

In an alternative embodiment, while the front face 500 is attached to the magnet 224 (shown in FIG. 2), a switch within the sensor 222 is normally open so that no current flows through the wires 506. However, when the front face 500 is no longer attached (i.e., the movable rail 112 in FIG. 1 and FIG. 2 is provided in the unfolded position), the switch within the sensor 222 closes and current flows through the wires 506. As such, an alarm is triggered and/or the boat is prevented from being turned on.

Figure 6:
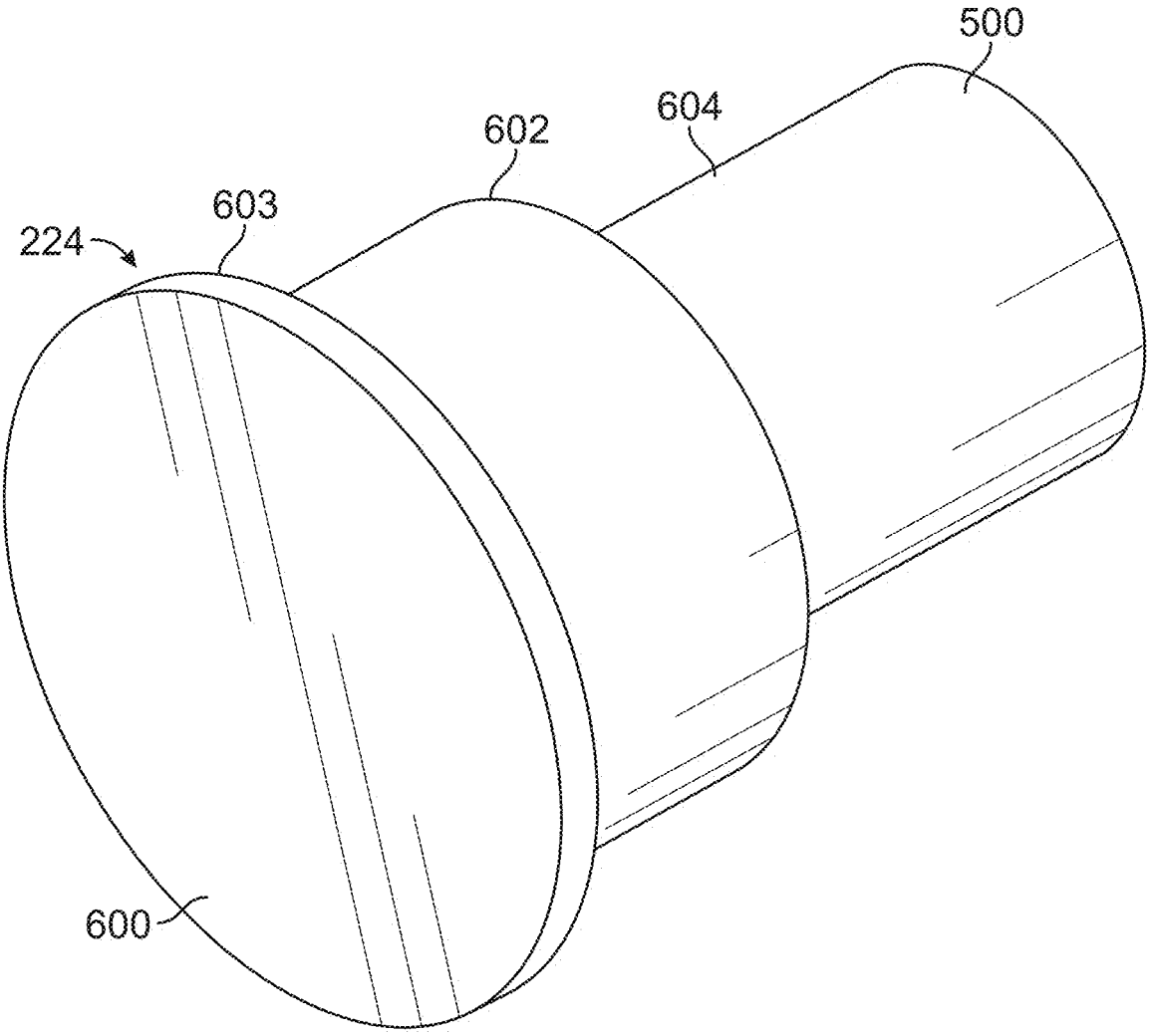
FIG. 6 illustrates one embodiment of a magnet provided by the boat ladder alarm system shown in FIG. 2.

FIG. 6 illustrates one embodiment of the magnet 224. The magnet 224 includes a front face 600 that fits within the magnet aperture 412 (shown in FIG. 4) of the back section 226 (shown in FIG. 2 and FIG. 4). A cylindrical section 602 is attached to a back face 603 oppositely disposed from the front face 600. Another cylindrical section 604 attaches to the back of the cylindrical section 602. Cylindrical sections 602, 604 are provided in the movable rail 112 (shown in FIG. 1 and FIG. 2).

While the front face 600 is attached to the front face 500 of the sensor 222 (shown in FIG. 2 and FIG. 5), current flows through the wires 506 (shown in FIG. 5). However, when the front face 600 is no longer attached (i.e., the movable rail 112 is provided in the unfolded position), the circuit within the sensor 222 opens and current no longer flows through the wires 506. As such, the alarm is triggered and/or the boat is prevented from being turned on.

Figure 7A:
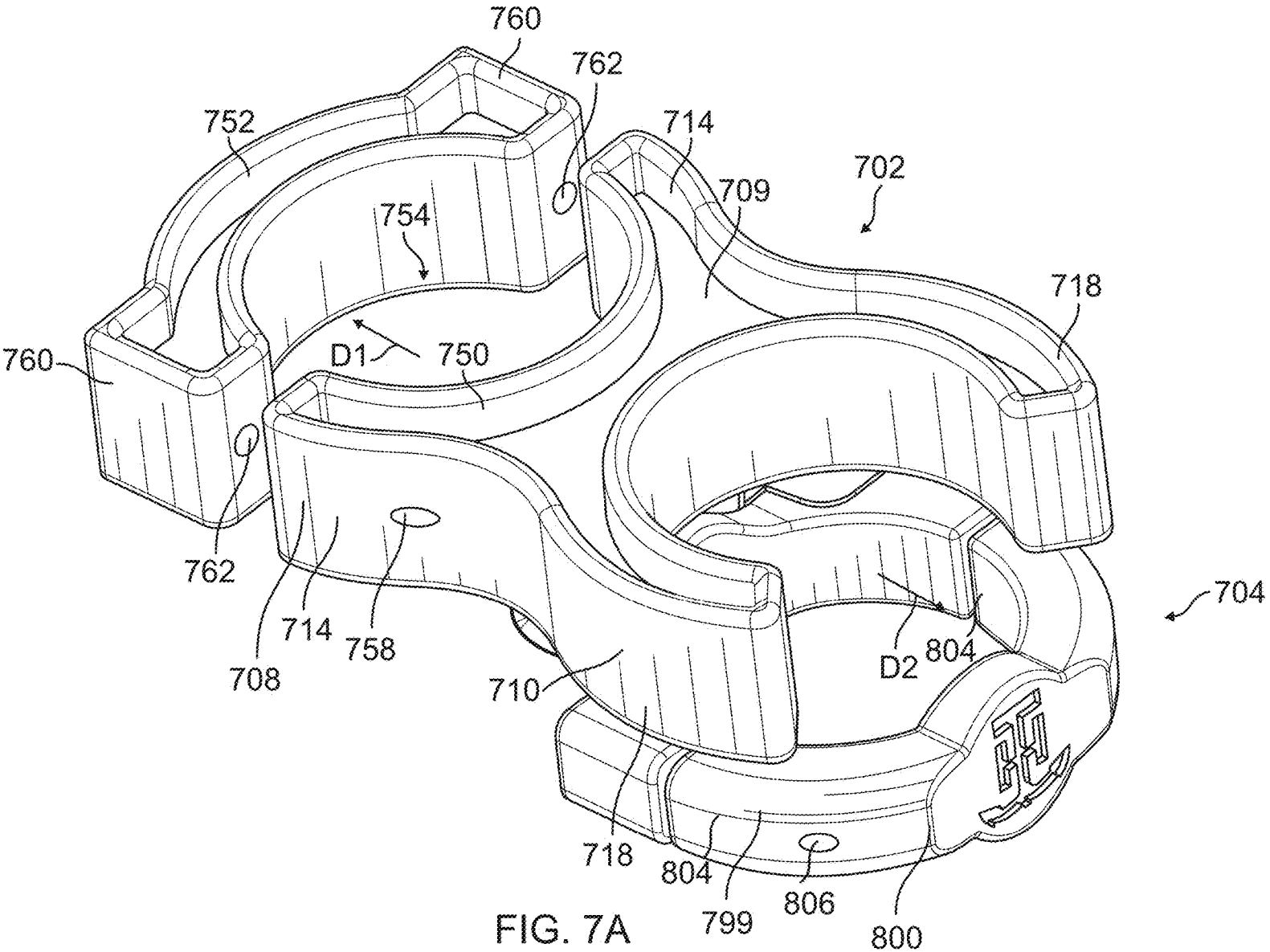
FIG. 7A and FIG. 7B are perspective view of another embodiment of the first and second bracket.
Figure 7B:
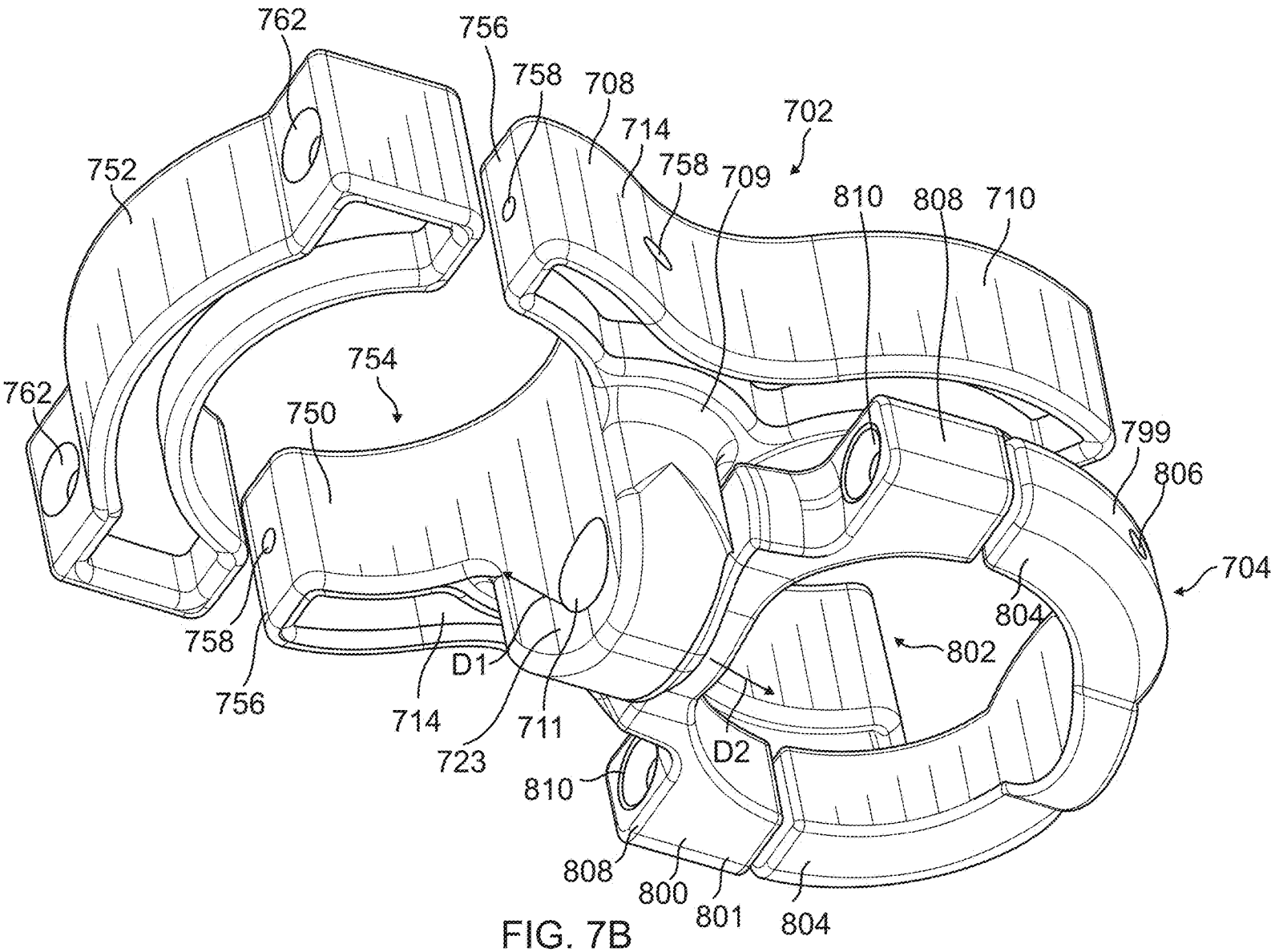

FIG. 7A and FIG. 7B illustrates another embodiment of a first bracket 702, similar to the first bracket 202 discussed above, and another embodiment of the second bracket 704, similar to the second bracket 204 discussed above. FIG. 7A is a perspective top view of the first bracket 702 and the second bracket 704 as they would be configured to engage the base rail 108 (See FIG. 2) and the movable rail (See FIG. 2). FIG. 7A is a perspective top view of the first bracket 702 and the second bracket 704 as they would be configured to engage the base rail 108 (See FIG. 2) and the movable rail (See FIG. 2). With respect to the first bracket 702, the first bracket 702 includes the oppositely disposed first grip 708 and second grip 710. The first grip 708 and the second grip 710 are attached and oppositely disposed to one another. The opposing arms 714 (only one in shown in FIG. 7) of the first grip 708 are provided in a circular shape since the base rail 108 (shown in FIG. 1 and FIG. 2) is circular. However, in other embodiments, the opposing arms 714 may take other shapes in accordance with the shape of the base rail they are designed to fit around. With regard to the second grip 710, the second grip 710 is formed by the opposing arms 718, which in this embodiment are also formed to have a circular shape since the movable rail 112 (shown in FIG. 1 and FIG. 7) is circular. However, in other embodiments, the opposing arms 718 may take other shapes depending on the shape of the movable rail they are designed to fit around.

As shown in FIG. 7, the first grip 708 and the second grip 710 connect at intersection 709, which is formed by the closed portions of the open loops that form the first grip 708 and the second grip 710. The section 723 extends vertically downward from the intersection 709 to provide a location for attaching the sensor 222. In this embodiment, the section 723 defines a sensor aperture 711. The sensor aperture 711 is configured to fit the sensor 222 (shown in FIG. 2 and FIG. 5) so that the sensor 222 can engage a magnet 900 (shown in FIG. 8), as explained in further detail below. The section 723 is shaped so that the appropriate portions of the sensor 222 face the D2 direction and, in this manner, can sense the movement of the movable rail 112. The sensor 222 (See FIG. 2) would extend in the D1 direction and would be inserted into the base rail 108.

In this embodiment, when disassembled, the first grip 708 is formed by an open loop 750 and a back section 752, which in this case also forms an open loop. The open loop 750 defines an opening 754 that fits around the base rail 108. Ends 756 of the open loop 750 have screw apertures 758. Similarly, ends 760 of the back section 752 may also define screw apertures 762. Ends 756, 760 and apertures 758, 762 may be aligned and screws may be inserted through the screw apertures 758, 762 to attach the open loop 750 to the back section 752 and thereby enclose the base rail 108. In this example, the open loop 750 and the back section 752 both have circular shapes since the base rail 108 is circular. However, other embodiments of the open loop 750 and the back section 752 may take other shapes in accordance with the shape of the base rail 108 they are designed to fit around.

With regard to the second bracket 704 shown in FIG. 7A and FIG. 7B, the second bracket 704 is formed as a third grip 800. When assembled, the third grip 800 forms a closed loop that is connected around the movable rail 112. When disassembled, the third grip 800 is formed by the open loop 799 and the back section 801, which in this case is largely planar. The open loop 799 defines an opening 802 that fits around the movable rail 112. Ends 804 of the open loop 799 have screw apertures 806. Similarly, ends 808 (See FIG. 8) of the back section 801 may also define screw apertures 810 (See FIG. 8). Ends 804, 808 and apertures 806, 810 may be aligned and screws may be inserted through the screw apertures 806, 810 to attach the open loop 810 to the back section 801 and thereby form the closed loop around the movable rail 112. In this example, the open loop 799 has a circular shape since the movable rail 112 is circular. However, other embodiments of the open loop 799 may take other shapes in accordance with the shape of the movable rail 112 it is designed to fit around.

Figure 8:
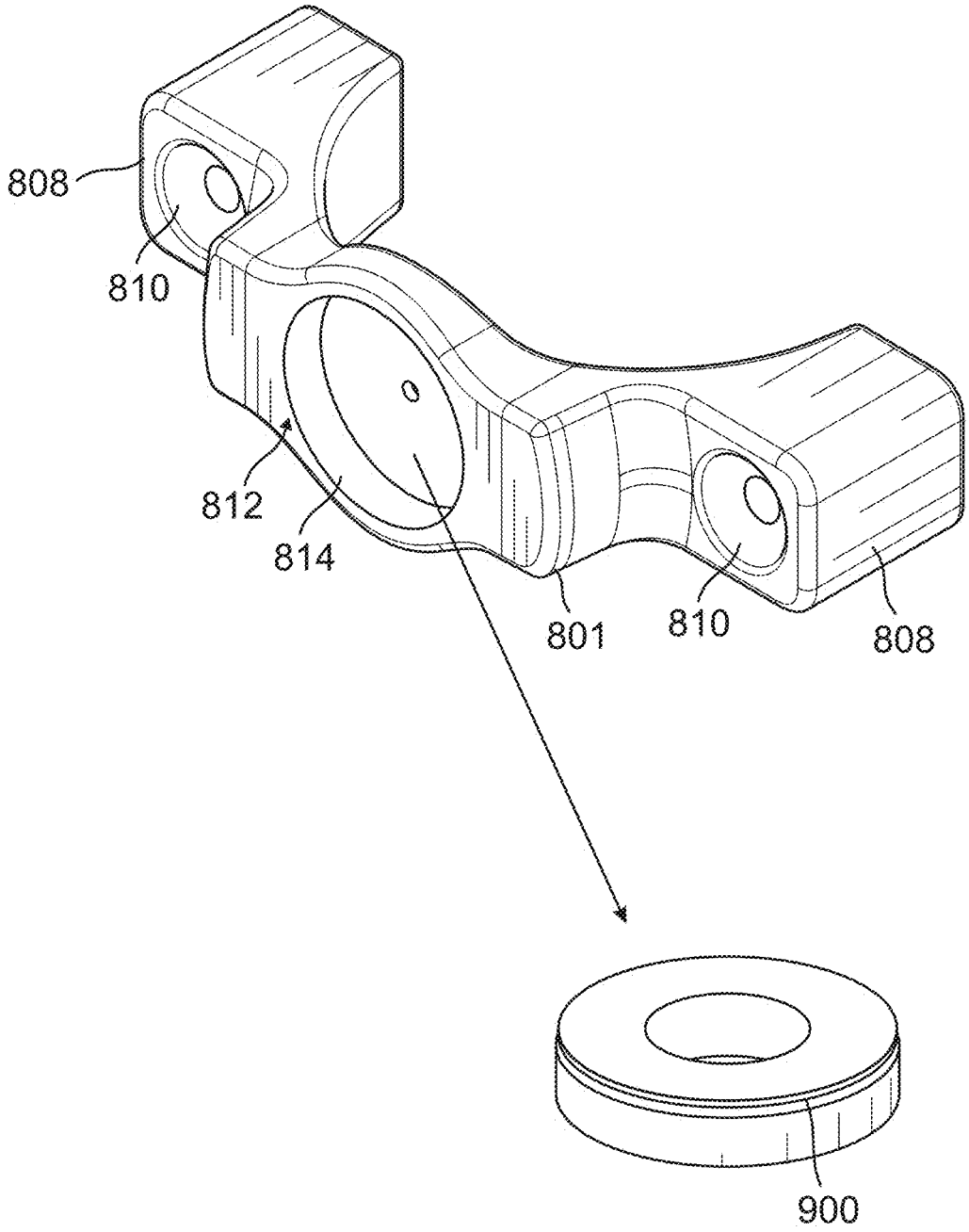
FIG. 8 illustrates another embodiment of a magnet for a boat ladder alarm system.

Referring now to FIG. 7A, FIG. 7B, and FIG. 8, FIG. 8 illustrates an embodiment of the back section 801 and a magnet 900 that is utilized instead of the magnet 600 shown in FIG. 6. The back section 801 has a magnet aperture 812, which in this case leads into a magnet pocket 814. Accordingly, the front face of the magnet 900 can fit through the magnet aperture 812 and face the D1 direction towards the sensor 222 (shown in FIG. 2 and FIG. 5). In this manner, the sensor 222 can easily detect the magnetic field created by the magnet 900. In an alternative embodiment, this arrangement allows for a switch in the sensor 222 to be maintained open by the magnet 900. The magnet 900 however would extend in the D2 direction and within the movable rail 112.

In this case, the magnet 900 is shaped as a toroid and fits within a tubular shaped magnet pocket 814. In one embodiment, both the magnet 900 and the magnet pocket 814 have a depth of approximately 0.135 inches and a diameter of approximately 9/16 of an inch. Since the magnet pocket 814 is tubular, the magnet aperture 812 is circular. In the above-described embodiment, the magnet aperture 812 may also have a diameter of approximately 9/16 of an inch.

FIGS. 9-13B illustrate a foldable boat ladder 1000 having a boat ladder alarm system 1100 according to another embodiment of the present disclosure. The boat ladder alarm system 1100 includes the sensor 222 and the magnet 224 described in detail above. However, in this embodiment, the sensor 222 is secured to a fixed base rail and a separate housing having the magnet 224 positioned therein is attached to a movable rail. The sensor 222 can detect the movement of the magnet 224 as it disengages from the sensor 222 when the boat ladder 1000 is deployed.

Figure 9:
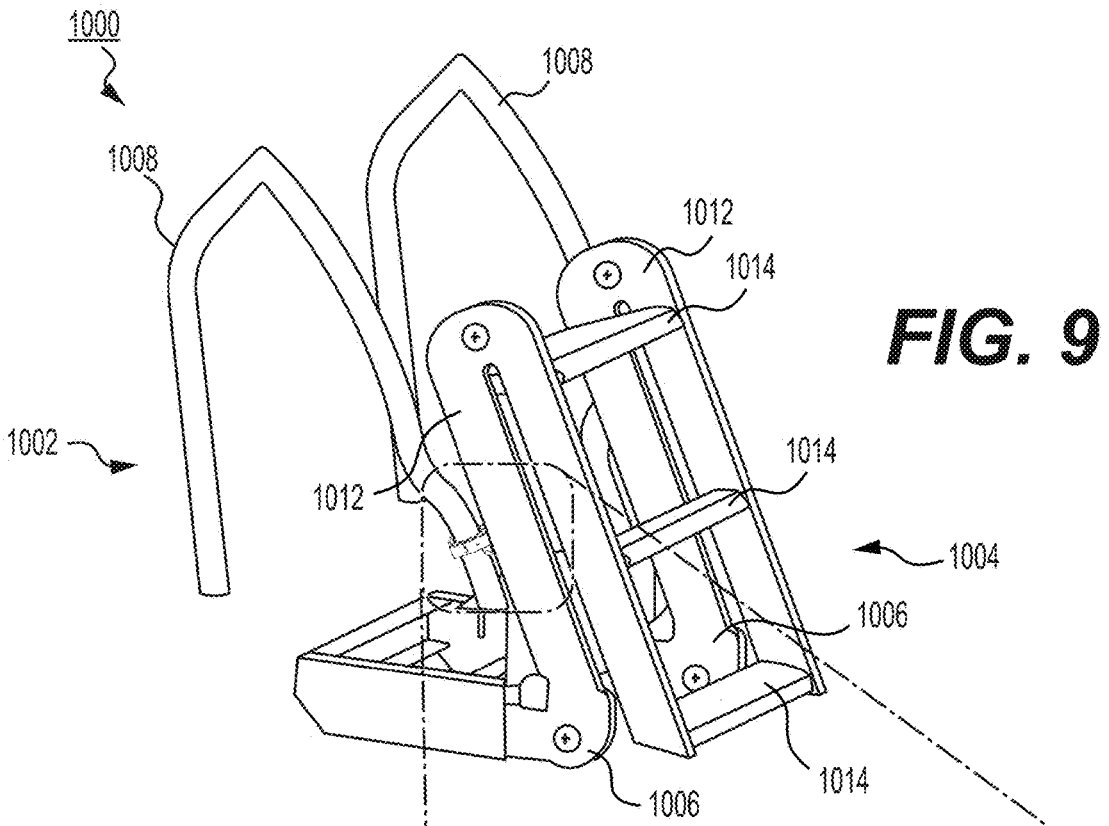
FIG. 9 illustrates a foldable boat ladder in a stowed position utilizing a boat ladder alarm system according to another embodiment of the present disclosure.

FIG. 9 illustrates the foldable boat ladder 1000 in the folded position. Similar to the foldable boat ladder 100 shown in FIGS. 1A and 1B, the foldable boat ladder 1000 includes a base ladder section 1002 that may be attached to a surface of a boat (not shown). For instance, the base ladder section 1002 may be attached to the hull of the boat by hooks, brackets, or other attachment mechanisms. The base ladder section 1002 is operatively connected to a movable ladder section 1004. As shown in FIG. 9, the movable ladder section 1004 is movably connected to the base ladder section 1002 by a pair of hinges 1006. The hinges 1006 permit the foldable boat ladder 1000 to be moved from the folded position to the unfolded position and vice versa. The base ladder section 1002 has a pair of base rails 1008. Additionally, the movable ladder section 1004 has a pair of movable rails 1012. Ladder steps 1014 are attached between the movable rails 1012. The boat ladder alarm system 1100 is operatively attached to the foldable boat ladder 1000 and positioned on the left side of the foldable boat ladder 1000. However, one of ordinary skill in the art will appreciate that the boat ladder alarm system 1100 may be positioned on either side of the foldable boat ladder 1000, and in some embodiments, may be utilized on both sides of the foldable boat ladder 1000. Moreover, while the ladder shown in FIG. 9 is a foldable boat ladder, those skilled in the art will recognize that the boat ladder alarm system 1100 can be used with other collapsible ladder configurations, such as ladders including portions that both fold and have rails that are collapsible, for example, using telescoping rails.

Figure 10:
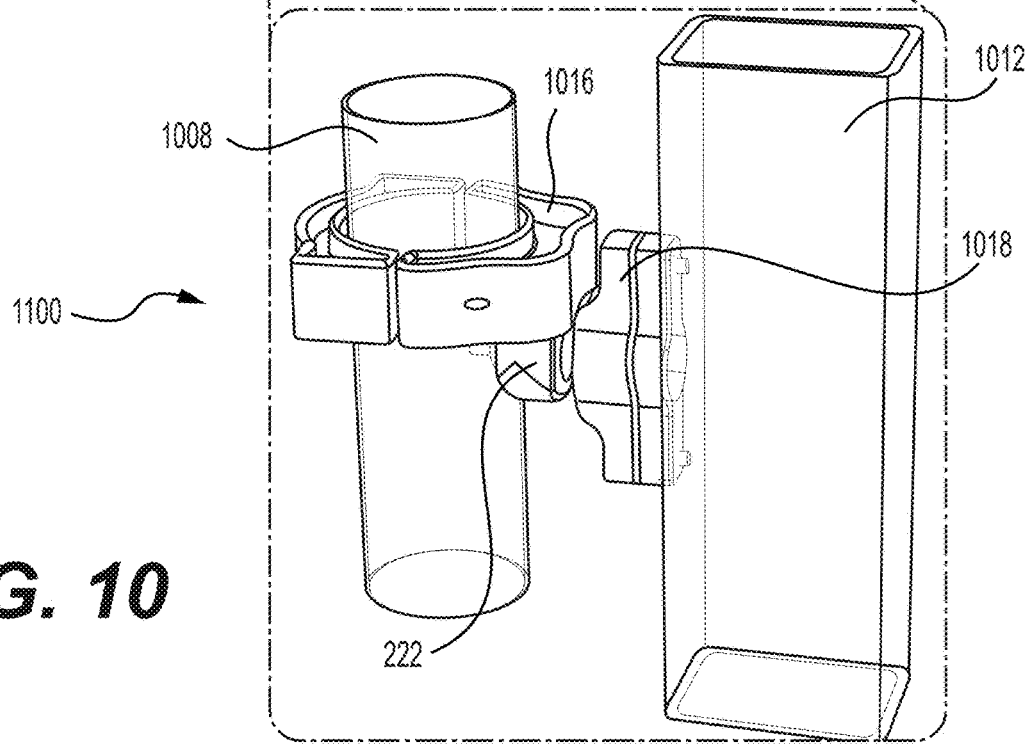
FIG. 10 illustrates an enlarged view of the boat ladder alarm system shown in FIG. 9.

FIG. 10 is an enlarged view of the boat ladder alarm system 1100 operatively attached to the foldable boat ladder 1000. The boat ladder alarm system 1100 includes the sensor 222 and the magnet 224 described above. However, in this embodiment, the sensor 222 is secured to the base rail 1008 using a bracket 1016 and a separate housing 1018 having the magnet 224 positioned therein is attached to the movable rail 1012. As illustrated in FIGS. 9 and 10, the sensor 222 and the magnet 224 are positioned on the base rail 1008 and the movable rail 1012, respectively, such that the sensor 222 and the magnet 224 align and engage with one another when the foldable boat ladder 1000 is in the folded position. This allows for the sensor 222 to trigger an alarm when the foldable boat ladder 1000 is unfolded and warn the operator of the boat that the foldable boat ladder 1000 is unfolded and someone may be climbing onto the boat. As those skilled in the art will appreciate, the bracket 1016 having the sensor 222 secured thereto and the housing 1018 having the magnet 224 attached thereto may be positioned at any location along the base rail 1008 and the movable rail 1012 so long as the positioning results in alignment of the sensor 222 and the magnet 224 when the foldable boat ladder 1000 is in the folded position.

In embodiments where the boat ladder system 1100 is used on a collapsible ladder configuration, for instance, a telescoping type ladder, the magnet 224 can be positioned on one of the lower movable portions of the telescoping ladder and the sensor 222 can be positioned on one of the upper fixed portions of the telescoping ladder. In this embodiment, when the ladder is collapsed in a closed/stowed position, the magnet 224 is positioned proximate to and operatively engaged with the sensor 222, and when the ladder is extended in a deployed position, the magnet 224 disengages from the sensor 222.

Figure 11A:
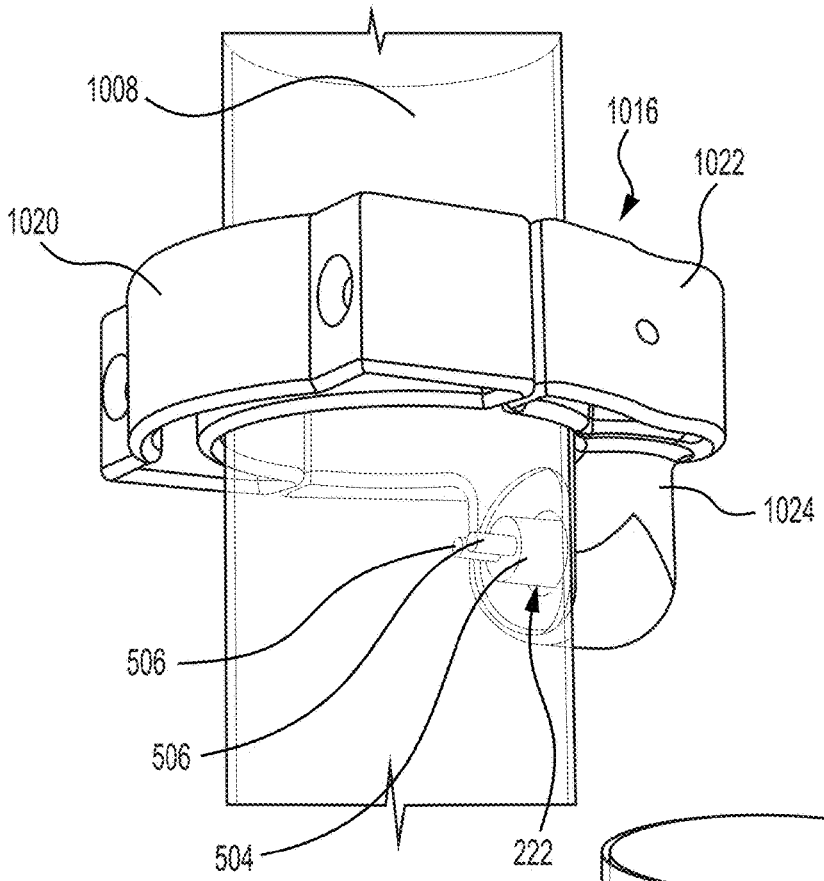
FIG. 11A and FIG. 11B illustrate a sensor provided by the boat ladder alarm system shown in FIG. 9.
Figure 11B:
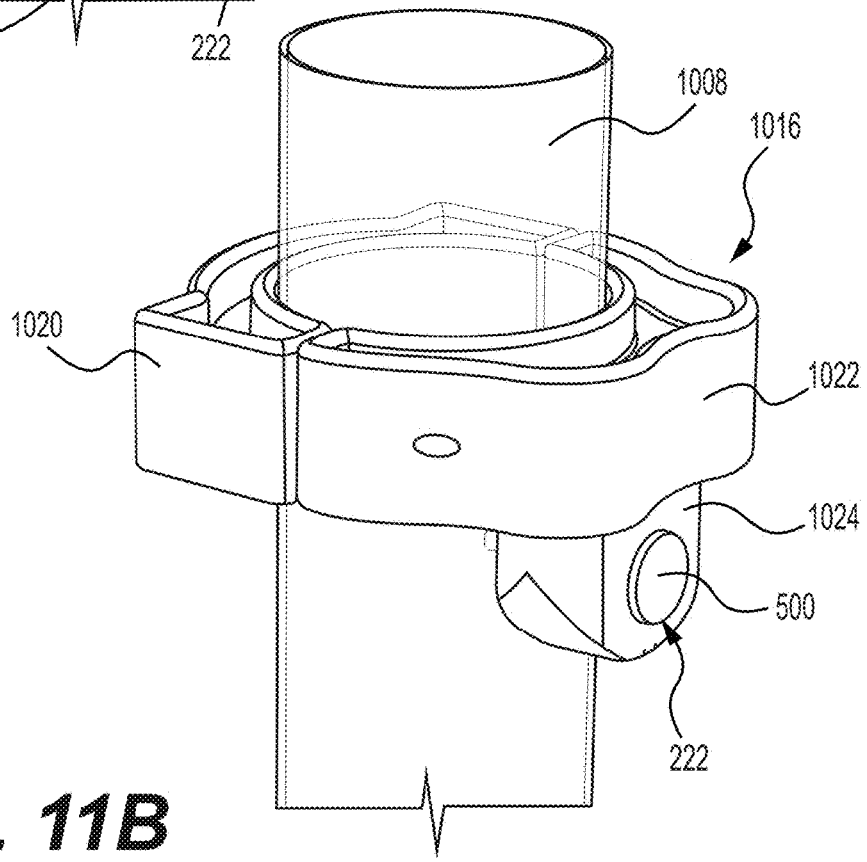

FIGS. 11A and 11B illustrate the bracket 1016 with the sensor 222 secured thereto. The bracket 1016 is attached to the base rail 1008. As shown in FIGS. 11A and 11B, the bracket 1016 is formed of a first grip 1020 and a second grip 1022. The first grip 1020 and the second grip 1022 each clamp around the base rail 1008 so that the first grip 1020 and the second grip 1022 form a closed loop that is connected around the base rail 1008. Each of the first grip 1020 and the second grip 1022 is provided in a circular shape since the base rail 1008 shown in the Figures is circular. However, in other embodiments, the first grip 1020 and the second grip 1022 may take other shapes in accordance with the shape of the base rail they are designed to fit around. The second grip 1022 includes a section 1024 formed integrally therewith that extends vertically downward from the bracket 1016 to provide a location for attaching the sensor 222.

As illustrated in FIGS. 11A and 11B, the sensor 222 is inserted through an aperture (not shown) in the section 1024 and into the base rail 1008. As discussed in detail above, the front face 500 of the sensor 222 fits within the aperture of the section 222. The cylindrical section 504 of the sensor 222 is provided in the base rail 1008 and the positive and negative wires 506 extend through the back of the cylindrical section 504 to transmit a signal.

Figure 12:
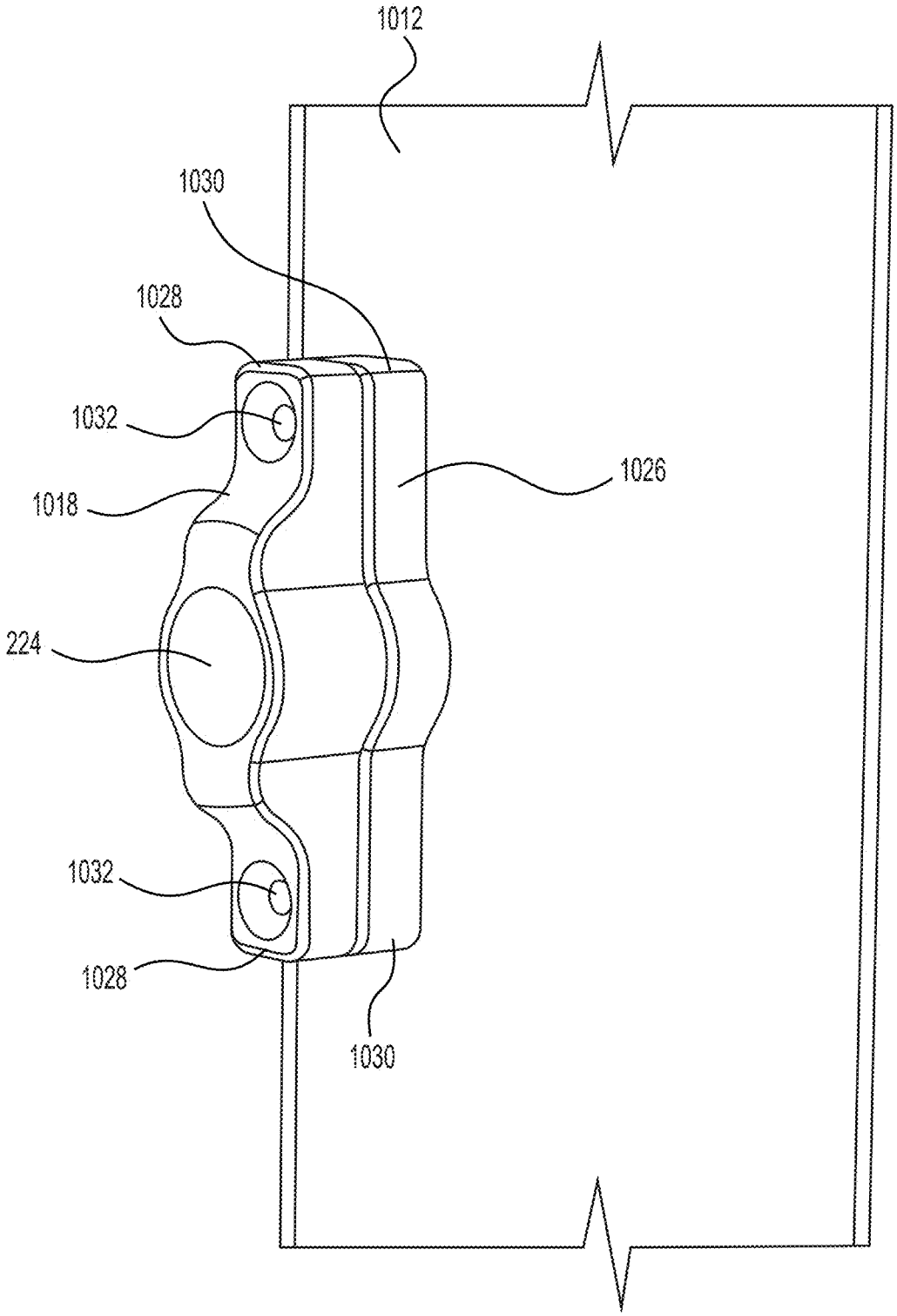
FIG. 12 illustrates a magnet provided by the boat ladder alarm system shown in FIG. 9.

FIG. 12 illustrates the housing 1018 having the magnet 224 positioned therein. As shown in FIG. 12, the housing 1018 is vertically attached to the movable rail 1012. The housing 1018 includes a magnet aperture (not shown). The front face of the magnet 224 can fit into the magnet aperture and face the direction towards the sensor 222 (shown in FIG. 10). In this manner, the sensor 222 can easily detect the magnetic field created by the magnet 224 when the foldable boat ladder 1000 is in the folded position.

In the illustrated embodiment, the housing 1018 is attached to a shim 1026. Different foldable boat ladders may have varying sized gaps between the base rails and movable rails when folded. The use of the shim 1026 ensures that the sensor 222 and the magnet 224 are sufficiently close to one another to allow the sensor 222 to detect the magnetic field created by the magnet 224. The width of the shim 1026 may vary depending on the size of the gap between the base rail and the movable rail on the particular type of foldable boat ladder.

Ends 1028 of the housing 1018 have screw apertures 1032. Similarly, ends 1030 of the shim 1026 may also define screw apertures 1034 (shown in FIG. 13B). Ends 1028, 1030 and the apertures 1032, 1034 may be aligned and screws may be inserted through the apertures to attach the housing 1018 and the shim 1026 to the movable rail 1012. While the use of screws is illustrated as an exemplary attachment mechanism, one of ordinary skill in the art will appreciate that other means for attaching the housing 1018 and the shim 1026 to the movable rail 1012 may be used (e.g., removable fasteners, adhesives, bolts, or rivets).

Figure 13A:
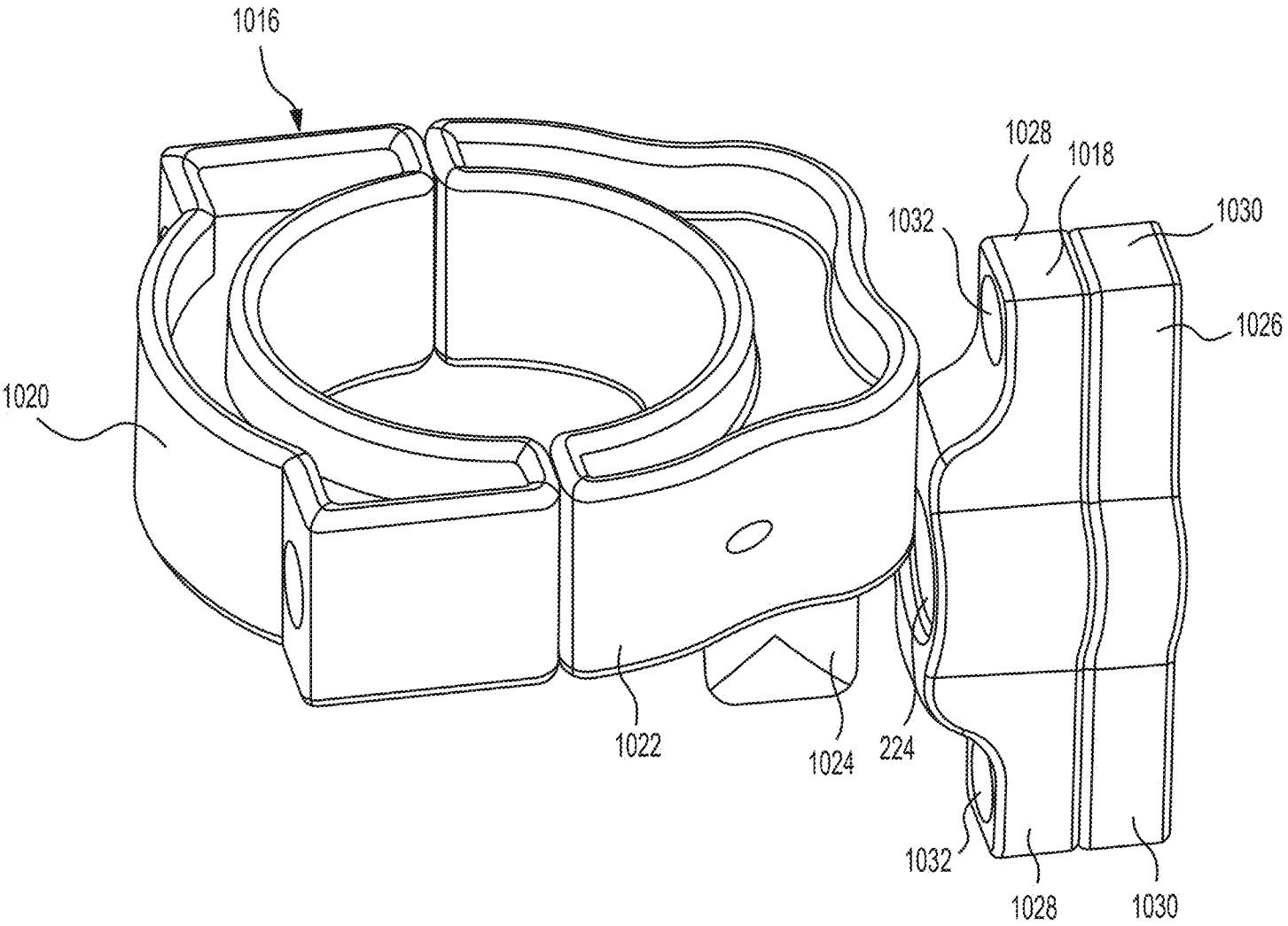
FIG. 13A and FIG. 13B illustrate perspective views of the boat ladder alarm system shown in FIG. 9.
Figure 13B:
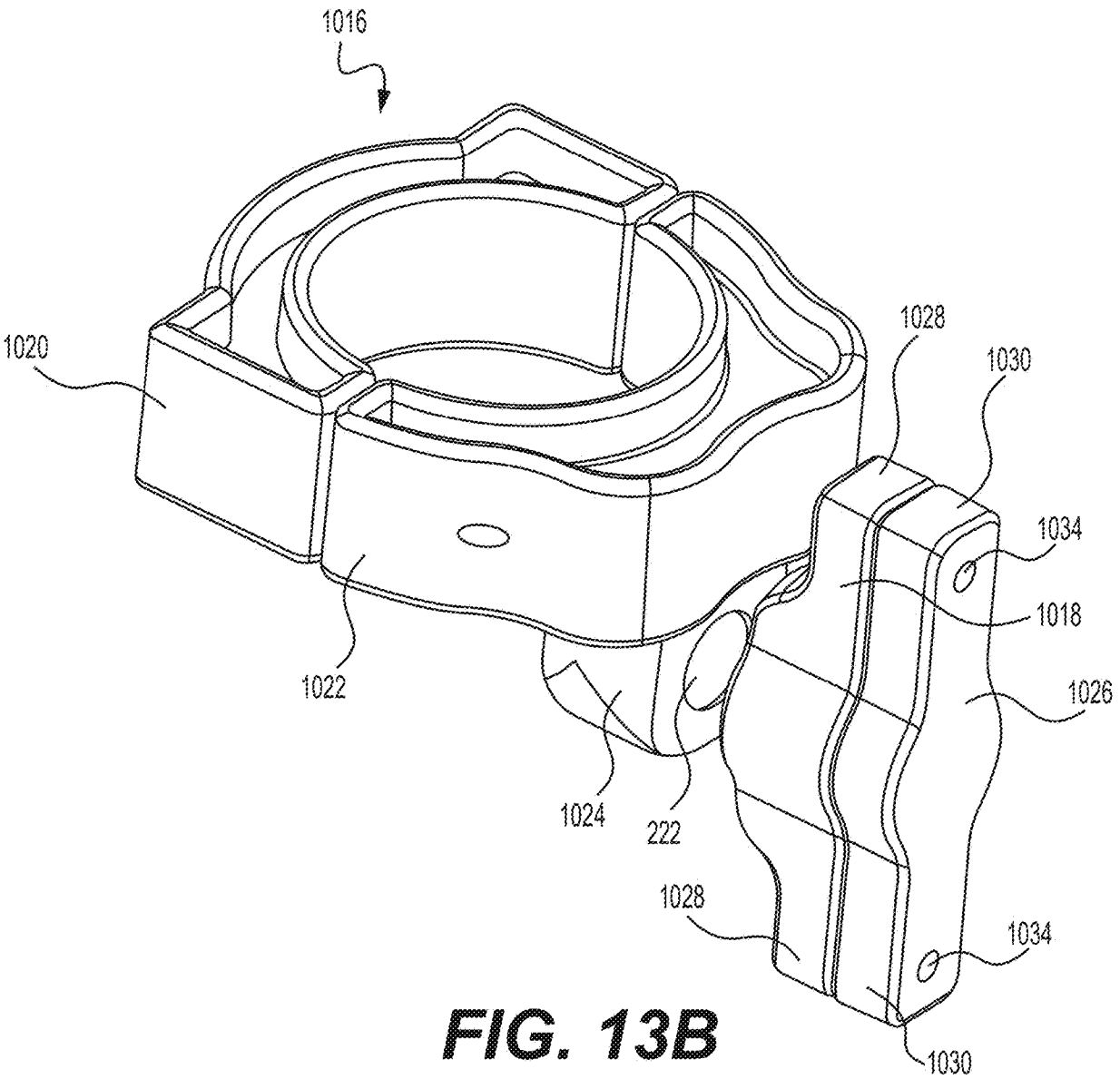

FIGS. 13A and 13B illustrate the boat ladder alarm system 1100. More specifically, FIGS. 13A and 13B show the positioning of the sensor 222 and the magnet 224 when the foldable boat ladder 1000 is in the folded position. When the foldable boat ladder 1000 is in the folded position, the front face 500 of the sensor 222 and the magnet 224 are aligned and engaged with one another. In this configuration, a circuit within the sensor 222 is closed so that current flows through the wires 506. However, when the front face 500 is no longer engaged with the magnet 224 (i.e., the movable rail 1012 in FIG. 9 is lowered and provided in the unfolded position), the circuit within the sensor 222 opens and current no longer flows through the wires 506. This triggers an alarm to alert the boaters that the foldable ladder is unfolded. The sensor 222 can also be configured to prevent the boat from starting when the magnet 224 is disengaged from the sensor 222.

Figure 14A:
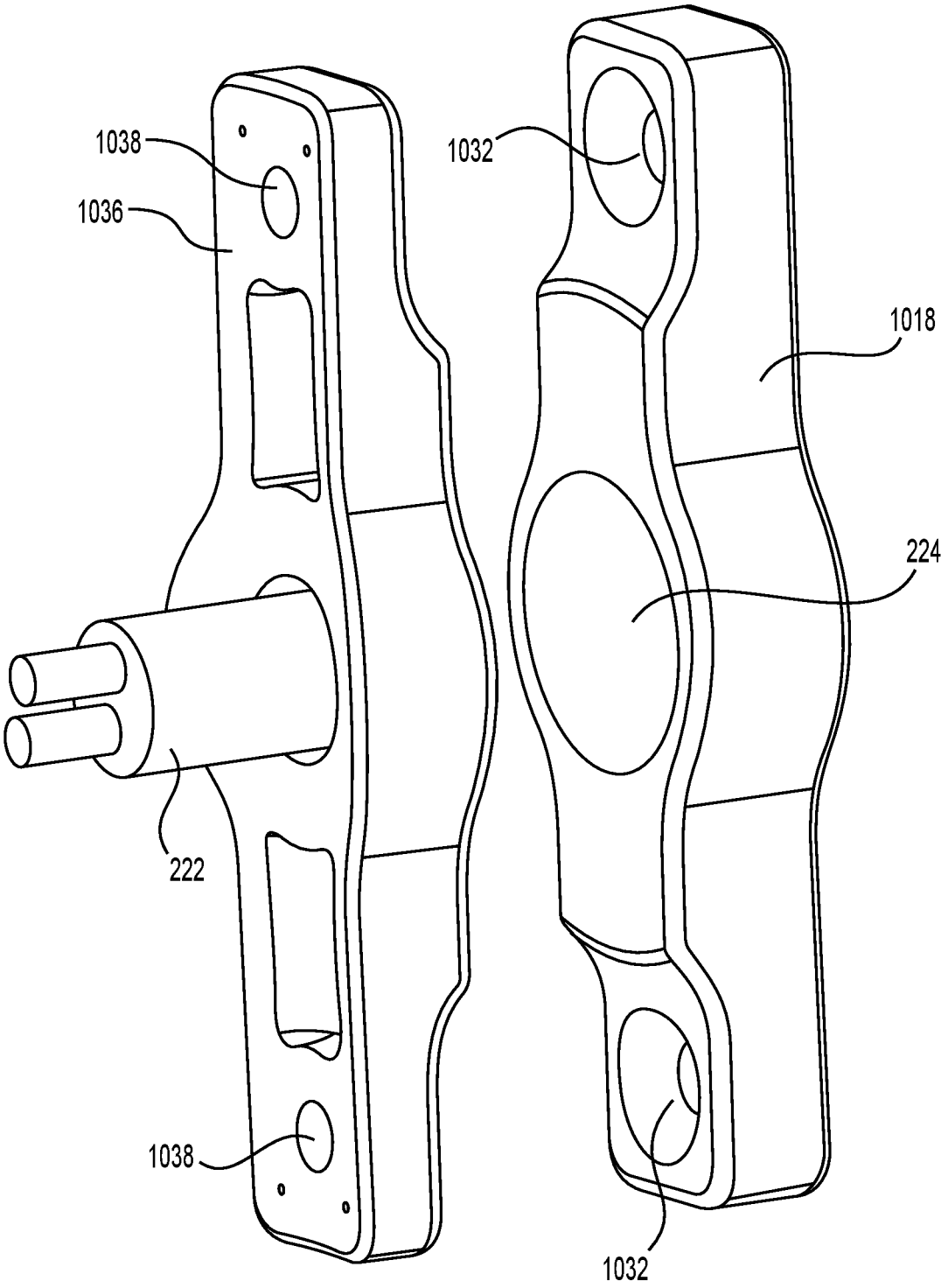
FIG. 14A and FIG. 14B illustrate perspective views of a boat ladder alarm system for use on a collapsible ladder configuration, for instance, a telescoping type ladder.
Figure 14B:
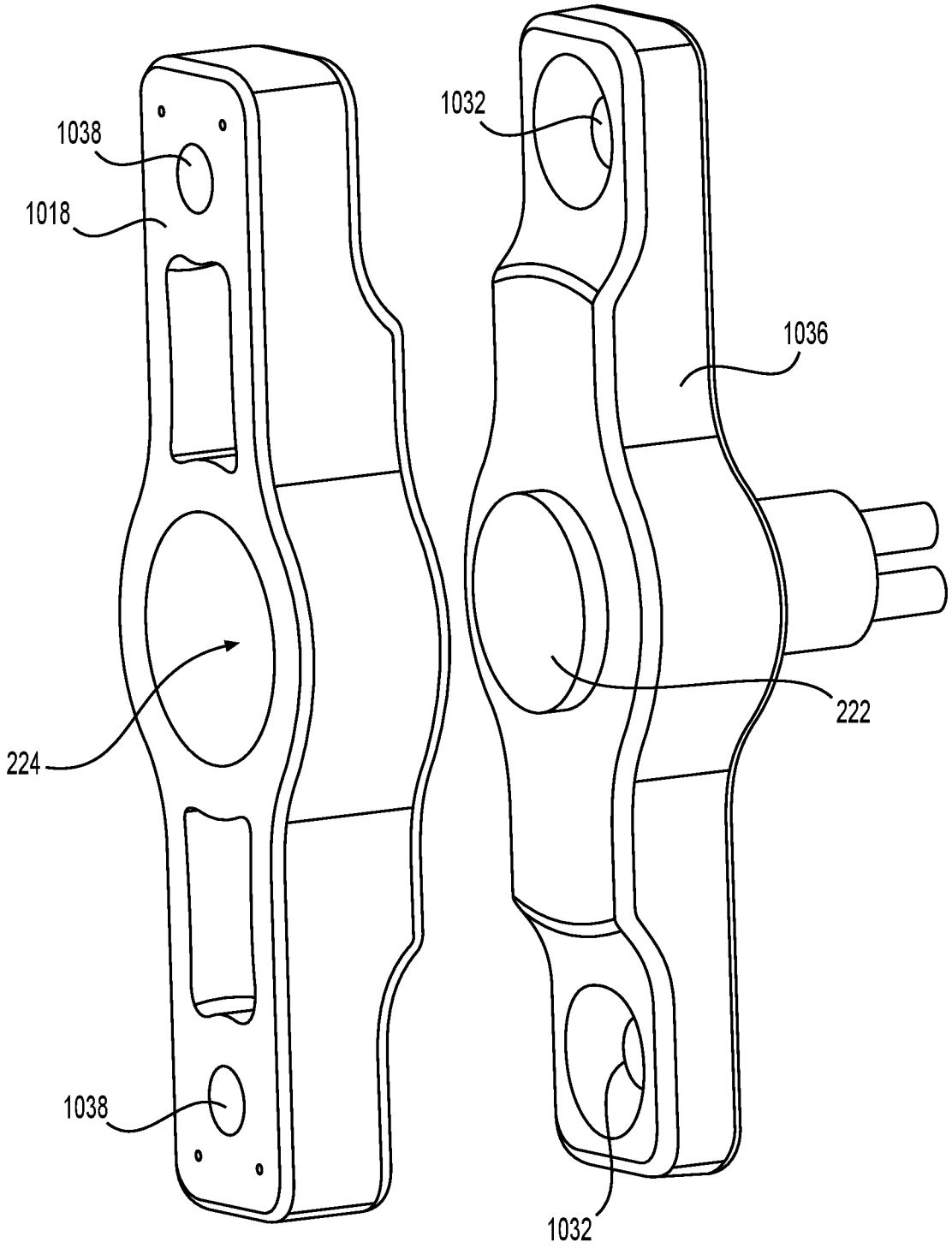

FIG. 14A and FIG. 14B illustrate perspective views of a boat ladder alarm system 1100 according to another embodiment of the present disclosure for use on a collapsible ladder configuration, for instance, a telescoping type ladder. The boat ladder alarm system 1100 includes the sensor 222 and the magnet 224 described in detail above. However, in this embodiment, the sensor 222 may be secured under a swim platform of the boat and the magnet 224 may be mounted to a top portion of the collapsible boat ladder.

As shown in FIGS. 14A and 14B, the magnet 224 is positioned in the housing 1018 and the sensor 222 is positioned in a housing 1036 (similar to the magnet housing 1018). The housing 1018 may be mounted to a top portion of the collapsible boat ladder using screw apertures 1032. The housing 1036 may also include a pair of screw apertures 1038 for mounting the housing 1036 to the swim platform of the boat.

In operation, when the ladder is collapsed in a closed/stowed position, the magnet 224, which is mounted to the top, tubular portion of the ladder, is positioned proximate to and operatively engaged with the sensor 222 that is mounted under the swim platform. When the ladder is extended in a deployed position, the magnet 224 disengages from the sensor 222 and the alarm is triggered.

Those skilled in the art will recognize improvements and modification to the preferred embodiments of the present disclosure. All such improvements and modifications are considered within the scope of the concepts disclosed herein and the claims that follow.

What is claimed is:

1. An alarm system for a foldable boat ladder having a fixed rail and a movable rail, comprising:

a sensor configured for attachment to the fixed rail, a magnet configured for attachment to the movable rail and engagement with the sensor when the foldable boat ladder is stowed, and wherein the sensor is configured to trigger an alarm when the magnet is disengaged from the sensor.

2. The alarm system of claim 1, wherein the sensor is secured to a bracket configured for receiving the fixed rail.

3. The alarm system of claim 2, wherein the bracket comprises a first grip and a second grip that form a closed loop around the fixed rail.

4. The alarm system of claim 3, wherein the bracket comprises a section that extends vertically downward from the second grip and defines a sensor aperture for receiving the sensor.

5. The alarm system of claim 1, wherein the magnet is provided in a housing configured for attachment to the movable rail.

6. The alarm system of claim 5, wherein the housing comprises a shim attached thereto.

7. The alarm system of claim 5, wherein the magnet is provided in the housing so as to face the sensor when the foldable boat ladder is stowed so that the alarm is turned off.

8. An alarm system for a foldable boat ladder having a fixed rail and a movable rail, comprising:

a sensor attached to the fixed rail, a magnet attached to the movable rail and operatively engaged with the sensor when the foldable boat ladder is stowed, and wherein the sensor is configured to prevent the boat from starting when the magnet is disengaged from the sensor.

9. The alarm system of claim 8, wherein the sensor is secured to a bracket, the bracket comprising a first grip and a second grip that form a closed loop around the fixed rail.

10. The alarm system of claim 9, wherein the bracket comprises a section that extends vertically downward from the second grip and defines a sensor aperture for receiving the sensor.

11. The alarm system of claim 8, wherein the magnet is provided in a housing configured for attachment to the movable rail.

12. The alarm system of claim 11, wherein the housing comprises a plurality of apertures for receiving a fastener.

13. The alarm system of claim 11, wherein the housing comprises a shim attached thereto for additional spacing.

14. The alarm system of claim 8, wherein the sensor is configured to allow the boat to start when the magnet is operatively engaged with the sensor.

15. An alarm system for a boat ladder, comprising:

a sensor configured to be attached to a first rail, a magnet configured to be attached to a second rail, wherein the magnet is positioned proximate to and operatively engaged with the sensor, and wherein the sensor is configured to perform at least one of the following when the magnet is disengaged from the sensor: trigger an alarm or prevent the boat from starting.

16. The alarm system of claim 15, wherein the first rail is a fixed rail of the boat ladder and the second rail is a movable rail of the boat ladder.

17. The alarm system of claim 15, wherein the boat ladder is a telescoping ladder.

18. The alarm system of claim 15, wherein the sensor is configured to prevent the boat from starting when the magnet is disengaged from the sensor and to allow the boat to start when the magnet is engaged with the sensor.

19. The alarm system of claim 15, wherein the sensor is configured to trigger an alarm when the magnet is disengaged from the sensor and to turn off the alarm when the magnet is engaged with the sensor.

20. The alarm system of claim 15, wherein the sensor is secured to a bracket, the bracket comprising a first grip and a second grip that clamp around the first rail.

* * * * *